US005098014A

United States Patent [19]

Perkins

[11] Patent Number: 5,098,014

[45] Date of Patent: Mar. 24, 1992

[54] COLLAPSIBLE, SELF-LOCKING, PAPERBOARD CARTON

[75] Inventor: William H. Perkins, Oxford, Ohio

[73] Assignee: Jefferson Smurfit Corporation, Clayton, Mo.

[21] Appl. No.: 739,103

[22] Filed: Aug. 1, 1991

[51] Int. Cl.[5] ..... B65D 5/36; B65D 5/46

[52] U.S. Cl. ..... 229/116; 229/8; 229/117; 229/117.15

[58] Field of Search ..... 229/108, 111, 116, 117, 229/117.14, 117.15, 8

[56] References Cited

U.S. PATENT DOCUMENTS

| | | | |
|---|---|---|---|
| 2,067,998 | 1/1937 | Williamson | 229/116 |
| 3,581,974 | 6/1971 | Freeman | 229/117.15 |
| 3,722,782 | 3/1973 | Collie | 229/117.15 |
| 4,063,679 | 12/1977 | Henry | 229/108 |
| 4,230,261 | 10/1980 | Austin | 229/117.14 |
| 4,313,556 | 2/1982 | Boyle et al. | 229/117 |
| 4,651,919 | 3/1987 | Wischusen, III | 229/117.14 |
| 4,765,533 | 8/1988 | Hoshiko et al. | 229/111 |

FOREIGN PATENT DOCUMENTS

| | | | |
|---|---|---|---|
| 2399360 | 3/1979 | France | 229/117.15 |

*Primary Examiner*—Gary E. Elkins
*Attorney, Agent, or Firm*—Richard W. Carpenter

[57] ABSTRACT

A collapsible, one-piece, bucket-type, paperboard carton especially suited for fast food operations. The carton has pairs of opposed side and end walls that tend to bow outwardly when the carton is erected, so that when handle panels which are foldably joined to top wall panels, are pushed downwardly the end walls automatically move inwardly until lock tabs projecting from the handle panels are received and locked within related end wall openings.

12 Claims, 4 Drawing Sheets

COLLAPSIBLE, SELF-LOCKING, PAPERBOARD CARTON

BACKGROUND OF THE INVENTION

1. Field of the Invention

This invention relates to one-piece, bucket-type, paperboard cartons having automatic bottoms and self-locking top closure arrangements with integral handles.

2. Description of the Background Art

A search of the background art conducted in the United States Patent and Trademark Office disclosed the following U.S. Pat. Nos.: 2,007,810; 2,067,998; 2,714,982; 3,079,062; 3,455,498; 3,581,974; 3,722,782; 3,809,310; 4,063,679; 4,260,097; 4,403,728; 4,651,919.

None of the patents found in the search discloses a one-piece, bucket-type, paperboard carton with an automatic bottom and with end walls arranged and disposed to bow outwardly from the side walls in such a way that, when top closure panels and attached handle panels are pushed downwardly to close the carton, the end walls will automatically move inwardly until lock tabs projecting from the ends of the handle panels are received and locked in related openings of the end walls.

SUMMARY OF THE INVENTION

It is a primary objective of the invention to provide a one-piece, bucket-type, paperboard carton with an integral handle that can be easily and quickly erected, filled, and closed, so as to be especially suitable for use in the fast food industry.

Another object of the invention, is the provision of a carton of the type described which has an automatic bottom and which also has an automatic top closure arrangement.

A more specific object of the invention is to provide a carton of the type described wherein the end walls are initially bowed outwardly, but which automatically move inwardly as the top wall panels and attached handle panels are pushed downwardly, to close the carton, until lock tabs on the handle panels are received and locked in related openings in the end walls.

These and other objects of the invention will be apparent from an examination of the following description and drawings.

It will be understood that, for purposes of clarity, certain elements may have been intentionally omitted from certain views where they are believed to be illustrated to better advantage in other views.

DESCRIPTION OF THE PREFERRED EMBODIMENT

Figure 1:
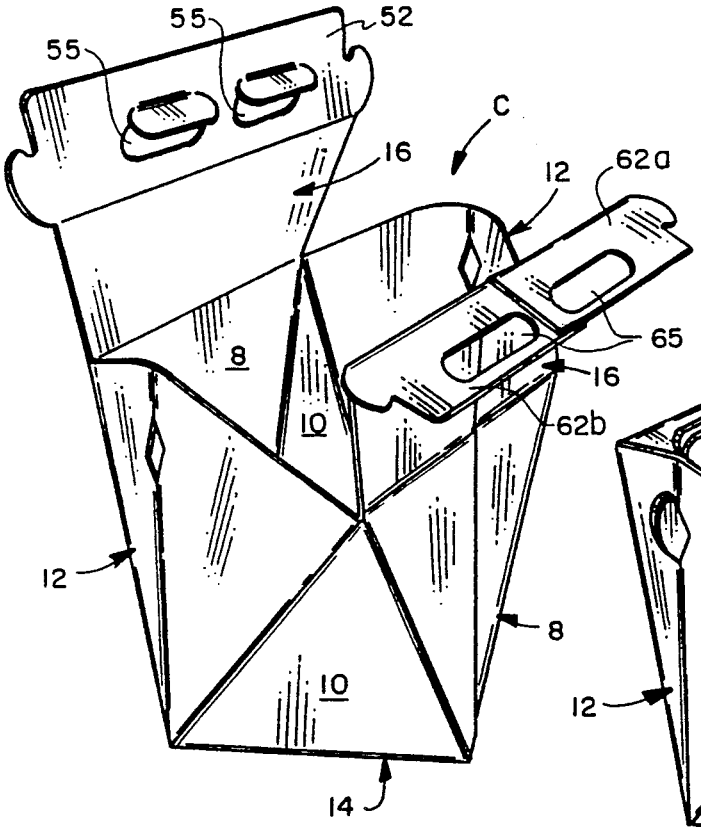
FIG. 1 is a fragmentary isometric view of an erected carton embodying features of the present invention, as seen in the open position.
Figure 2:
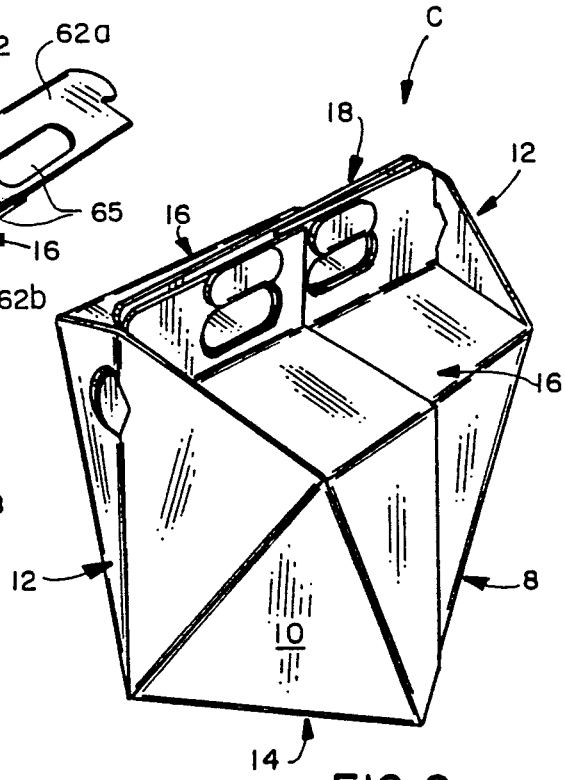
FIG. 2 is a view similar to that of FIG. 1, but showing the carton in the closed position.
Figure 3:
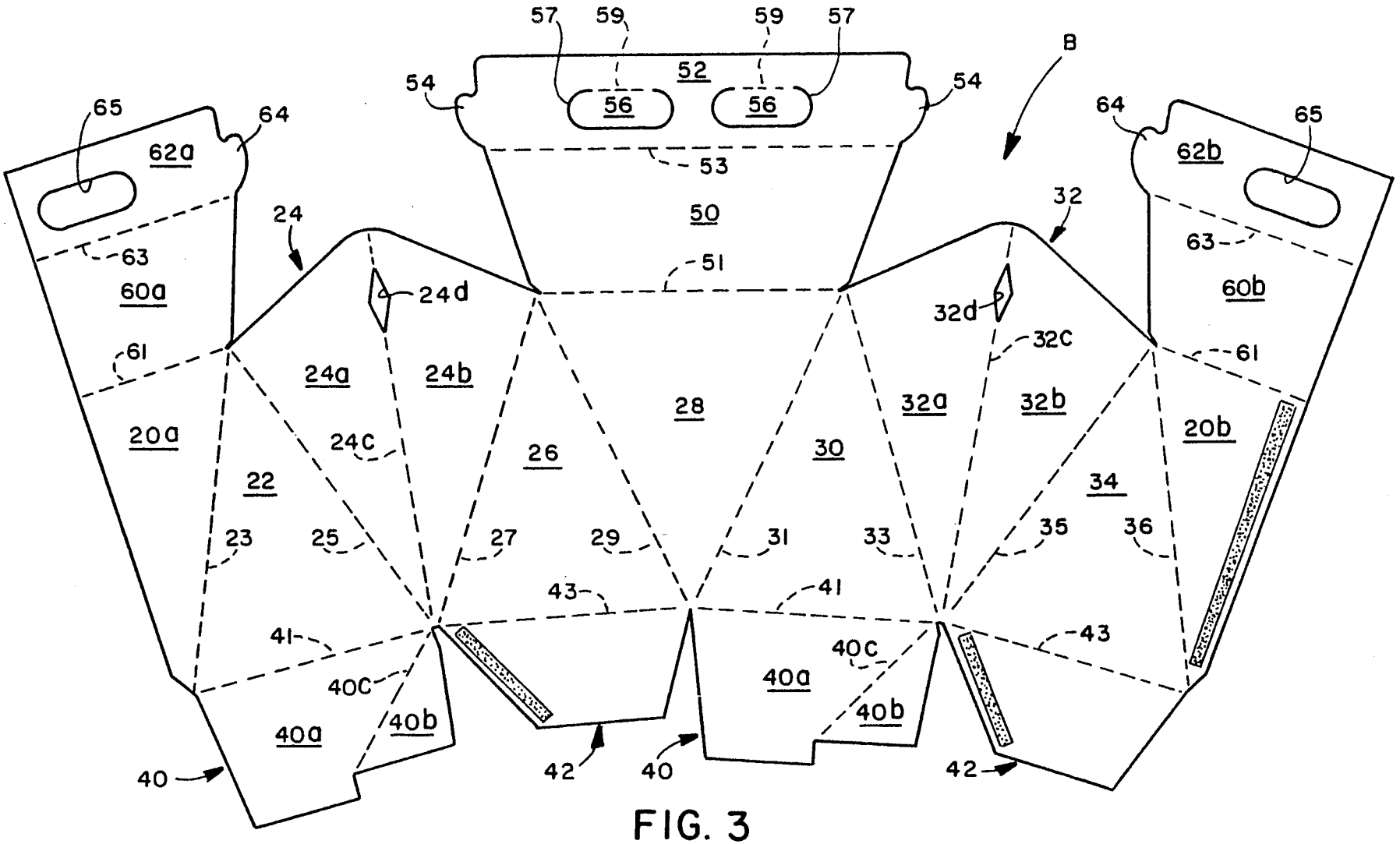
FIG. 3 is a plan view of a blank of sheet material from which the carton illustrated in the other views may be formed.

Referring now to the drawings for a better understanding of the invention, it will be seen that the one-piece, bucket-type carton C illustrated in FIGS. 1 and 2 can be formed from the unitary blank B of foldable sheet material, such as paperboard, illustrated in FIG. 3.

As best seen in FIG. 1, Carton C comprises a pair of first and second side walls 8 and 10, respectively, and a pair of end walls 12 that are foldably interconnected to form a tubular structure with a bottom wall 14, a top wall 16, and a handle 18.

It will be seen that the body portion of the carton comprises a plurality of triangular panels and panel sections that include the following as illustrated from left to right in FIG. 3: first side wall center panel section 20*a*, first side wall side panel 22, first end wall panel section 24*a*, first end wall panel section 24*b*, second side wall side panel 26, second side wall center panel 28, second side wall side panel 30, second end wall panel section 32*a*, second end wall panel section 32*b*, first side wall side panel 34, and first side wall center panel section 20*b*, which are foldably joined to each other along diverging fold lines 23, 25, 24*c*, 27, 29, 31, 33, 32*c*, 35, and 37, respectively.

End walls 24 and 32 are preferably diamond shaped, as they are each formed from a pair of triangular panel sections foldably joined to each other. Each end wall has an upper portion that extends above the upper extremities of the side walls and that has extending therethrough a lock tab receiving opening 24*d* or 32*d* which is located at the fold line that joins the end wall panel sections to each other.

The lower end of the carton may be closed by a conventional automatic lock bottom closure arrangement that includes a pair of major flaps 40, foldably joined to lower edges of side wall side panels 22 and 30 on fold lines 41, and minor flaps 42, foldably joined to lower edges of side wall side panels 26 and 34 on fold lines 43.

Each of the major flaps includes a larger section 40*a* and a smaller section 40*b* which are foldably joined to each other along a fold line 40*c*.

The essential novel feature of the invention resides in the relation of the end walls to the top wall closure panels and the integral handle panels, as hereinafter described.

Still referring to FIG. 3 of the drawings, it will be seen that a top wall panel 50 is foldably joined at its outboard edge on fold line 51 to the upper edge of second side wall center panel 28, and a handle panel 52 is foldably joined at its lower edge on fold line 53 to the inboard edge of top wall panel 50.

Handle panel 52 includes a pair of integral, ear-shaped, lock tabs 54 that project laterally outward from opposite ends thereof and that are adapted to be received and locked within related openings 24*d* and 32*d* in the respective end walls.

Handle panel 52 also includes a pair of finger receiving hand holes 55. If desired, handle panel 52 may be provided with hand hole flaps 56 which are defined by cut lines 57 and hinged to the handle panel on fold lines 59.

When the carton is closed and the handle panels are brought together, as hereinafter described, the flaps 56 may be inserted in related hand holes 65 of the other handle panel 62 and folded back 180 degrees to lock the handle panels together.

Similarly, top wall panel sections 60*a* and 60*b*, which together form top wall panel 16, are foldably joined at their outboard edges on fold lines 61 to upper edges of first side wall center panel sections 20*a* and 20*b*, respectively.

Also handle panel sections 62*a* and 62*b*, which together form handle panel 62, are foldably joined at their lower edges on fold lines 63 to adjacent top wall panel sections 60*a* and 60*b*, respectively. Handle panel sections 62*a* and 62*b* each include a lock tab 64 and a handle hole 65.

In order to form the collapsible carton C from the blank B, the bottom closure flaps are folded inwardly 180 degrees against the inner surfaces of the panels to which they are foldably joined, and the smaller sections 40*b* of the major flaps 40 are reverse folded 180 degrees and adhesively secured to adjacent portions of the respective minor flaps 42.

At the same time, as opposite ends of the blank are folded upon each other in overlapping relation, first side wall center panel sections 20*a* and 20*b* are secured to each other as are top wall sections 60*a* and 60*b* and handle panel sections 62*a* and 62*b*.

Figure 4:
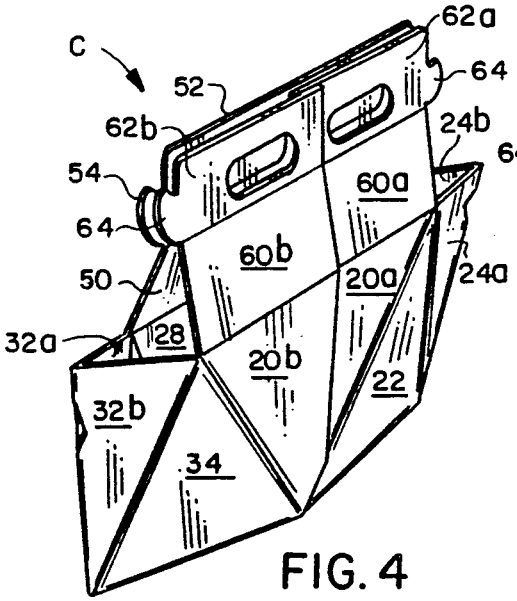
FIG. 4 is a view similar to that of FIG. 1, but showing the carton in a partially collapsed position.
Figure 5:
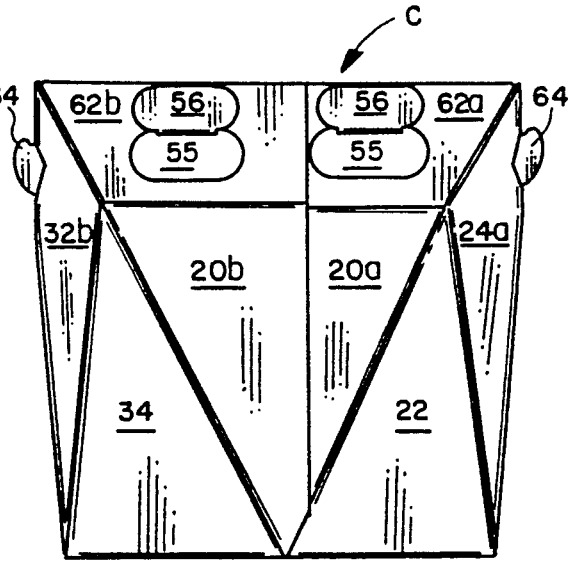
FIG. 5 is a side elevational view of the structure illustrated in FIG. 2.

At this point the carton can be shipped in the collapsed position, as seen in FIG. 4, and is ready for use by a packer, such as a fast food operation.

As best seen in FIG. 1, when the carton is erected and in the open position, because of the unique configuration of the carton walls, initially the end walls of the carton tend to bow outwardly from the side walls. After the carton has been filled, when the operator grasps the handle panels to bring them together and, at the same time, pushes the top wall panels downwardly, as the side walls move outwardly, the end walls automatically move inwardly until the handle panel lock tabs are received and locked within the lock tab receiving openings of the respective end walls.

Figure 6:
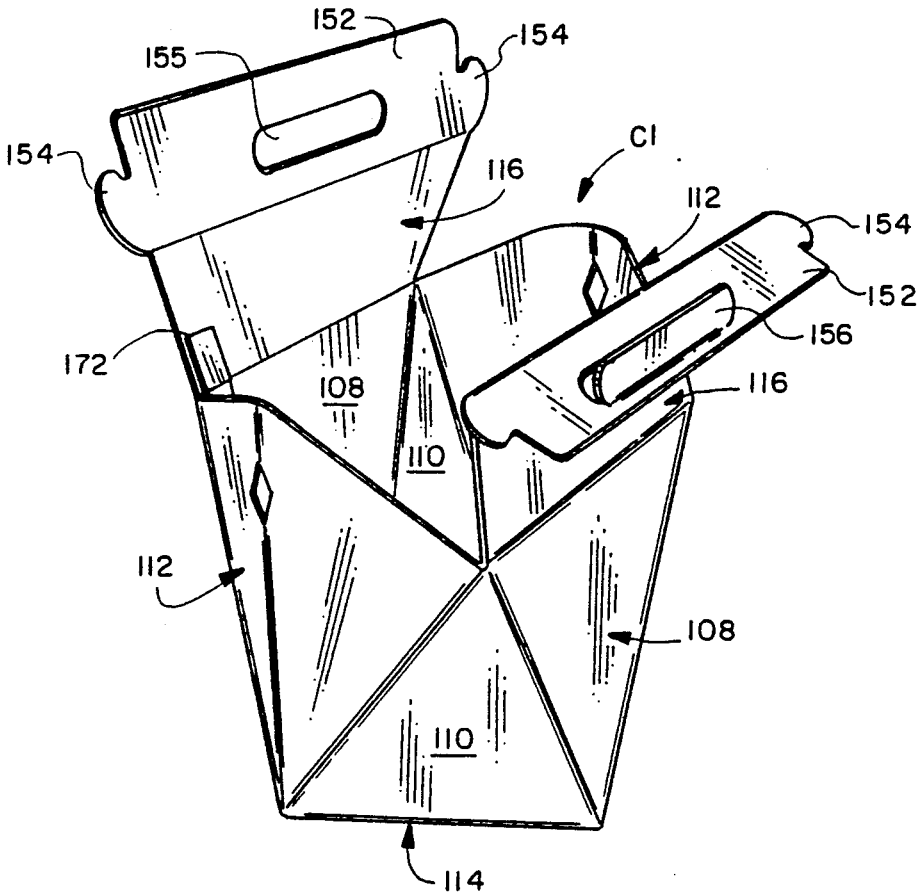
FIGS. 6 and 7 are views similar to FIGS. 1 and 5, respectively, but show a modified form of the invention.
Figure 7:
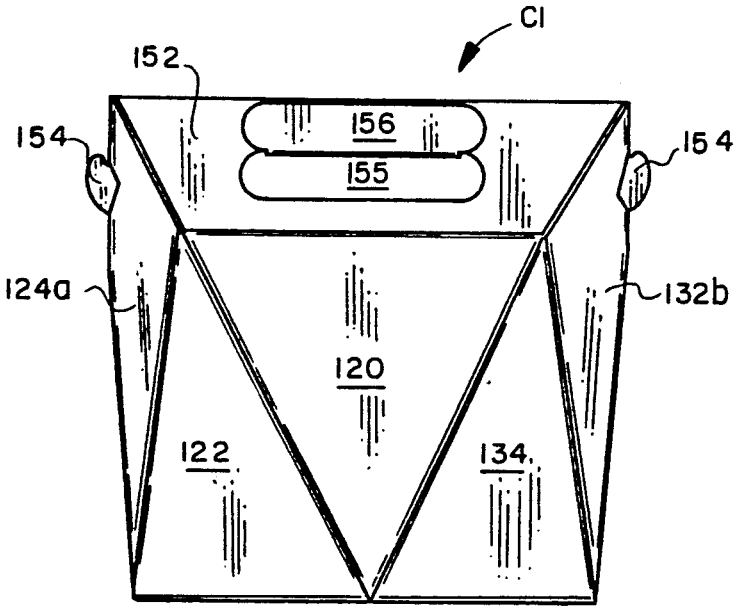
Figure 8:
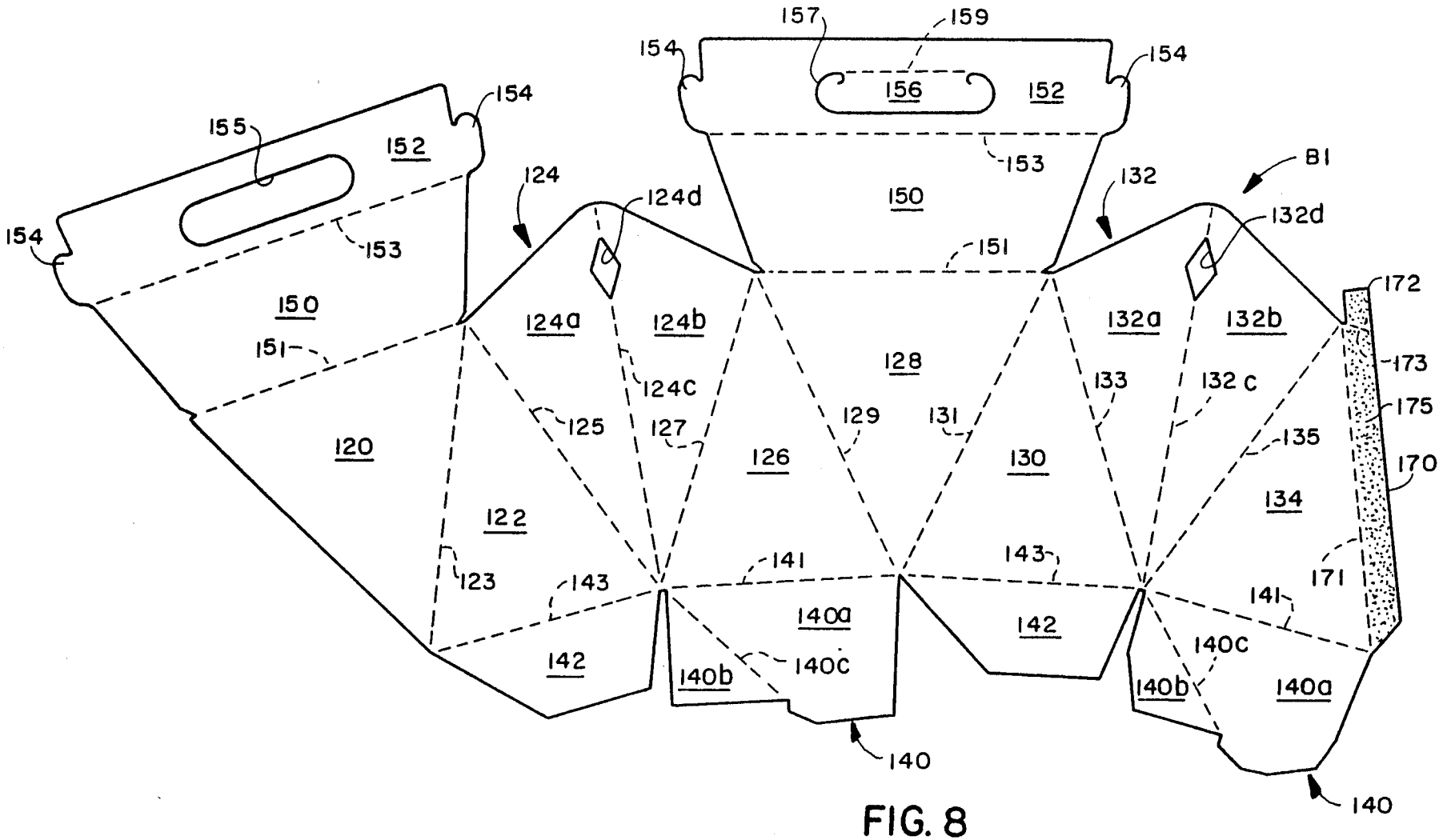
FIG. 8 is a plan view of the blank of sheet material from which the carton illustrated in FIGS. 6 and 7 may be formed.

A slightly modified form of the invention is illustrated in FIGS. 6–8. In this embodiment the carton C1, illustrated in FIGS. 6 and 7, is substantially the same as carton C, illustrated in FIGS. 1, 2, 4, and 5; however it is formed from a blank B1, illustrated in FIG. 8, which has a slightly different configuration than blank B, illustrated in FIG. 3. In describing the carton C1 and the blank B1, related elements have been identified by corresponding numerals.

Turning now to FIG. 8, it will be seen that the body portion of carton C1 comprises a plurality of triangular panels and panel sections that include the following as illustrated from left to right in FIG. 8: first side wall center panel 120, first side wall side panel 122, first end wall panel section 124*a*, first end wall panel section 124*b*, second side wall side panel 126, second side wall center panel 128, second side wall side panel 130, second end wall panel section 132*a*, second end wall panel section 132*b*, first side wall side panel 134, and glue panel 170 which are foldably joined to each other along diverging fold lines 123, 125, 124*c*, 127, 129, 131, 133, 132*c*, 135, and 171, respectively.

Glue panel 170 has an extension 172 foldably joined to its upper edge along a fold line 173. Glue or other adhesive 175 is applied to one surface of both the glue panel and the extension, so the glue panel and extension can be secured to marginal portions of first side wall center panel 120 and related top wall panel 150, as best seen in FIG. 6.

Diamond shaped end walls 124 and 132 have upper portions that extend above the upper extremities of the side walls and present lock tab receiving openings 124*d* and 132*d*, respectively, located at the fold lines that join the end wall panel sections to each other.

The lower end of the carton may be closed by a conventional automatic lock bottom closure arrangement, similar to that of the previously described embodiment, that includes a pair of major flaps 140, foldably joined to lower edges of side wall side panels 126 and 134 on fold lines 141, and minor flaps 142, foldably joined to lower edges of side wall side panels 122 and 130 on fold lines 143.

Each of the major flaps includes a larger section 140*a* and a smaller section 140*b* which are foldably joined to each other along a fold line 140*c*.

The handle arrangement, which is the essential feature of the invention, is similar to that of the previously described embodiment. As seen in FIGS. 6 and 8, a pair of top wall panels 150 are foldably joined at their outboard edges to upper edges side wall center panels 120 and 128 along fold lines 151.

A pair of handle panels 152 are foldably joined at their lower edges to inboard edges of top wall panels 150 along fold lines 153.

Each handle panel 152 includes a pair of integral, ear-shaped, lock tabs 154 that project laterally outward from opposite ends thereof and that are adapted to be received and locked within related openings 124*d* and 132*d* in the respective end walls.

Each handle panel 152 also includes a hand hole 155. If desired, one of the handle panels may be provided with a hand hole flap 156 which is defined by a cut lines 157 and hinged to the handle panel on fold line 159.

Thus, each embodiment of the carton of the present invention is particularly suitable for fast food operations, wherein an operator can fill the carton with one hand and easily and quickly close and lock the carton with the other hand.

What is claimed is:

1. A collapsible, one-piece, bucket type carton having an integral handle and having upper and lower ends that are closable by top and bottom self-locking closure arrangements, said carton being formed from a unitary blank of foldable sheet material such as paperboard, and comprising:

(a) a body including a pair of front and rear side walls and a pair of end walls foldably joined to each other to form a tubular structure open at its upper and lower ends;

(b) each of said side walls including:

(i) a triangular center panel, with a horizontally disposed upper edge and a pair of downwardly converging side edges;

(ii) a pair of triangular side panels each having a horizontally disposed lower edge and a pair of upwardly converging side edges, one of which is foldably joined to an adjacent side edge of said center panel;

(c) each of said end walls being diamond shaped and including a pair of triangular panel sections, each panel section having a pair of upwardly diverging side edges, with their adjacent side edges foldably joined to each other and with their remote side edges foldably joined to adjacent side edges of respective side wall side panels;

(d) each of said end walls having an upper portion extending above said side walls and presenting a lock tab receiving opening located at a fold line joining said end wall panel sections;

(e) bottom closure flaps foldably joined to lower edges of said side wall side panels and secured to each other in overlapped relation to form an automatically erectable bottom;

(f) top closure panels having outboard edges foldably joined to upper edges of said side wall center panels and having inboard edges;

(g) handle panels having lower edges foldably joined to adjacent inboard edges of respective top closure panels and having at opposed ends thereof laterally projecting lock tabs adapted to be received within related end wall openings;

(h) said end walls being arranged and disposed to bow outwardly from said side walls when said carton is erected, so that when said carton is filled and said top closure panels are lowered to closed position with said handle panels in face-to-face relation, said end walls will automatically move inwardly until said handle panel lock tabs are received and locked within said end wall openings.

2. A carton according to claim 1, wherein said handle panels have aligned finger receiving openings extending therethrough.

3. A carton according to claim 1, wherein the center and side panels of each of said side walls that are disposed to lie in separate planes.

4. A collapsible, one-piece, bucket type carton having an integral handle and having upper and lower ends that are closable by top and bottom self-locking closure arrangements, said carton being formed from a unitary blank of foldable sheet material such as paperboard, and comprising:

(a) a body including a pair of front and rear side walls and a pair of end walls foldably joined to each other to form a tubular structure open at its upper and lower ends;

(b) each of said side walls having laterally extending upper and lower edges;

(c) each of said end walls having a pair of upwardly diverging side edges foldably joined to adjacent side edges of respective side walls;

(d) each of said end walls having an upper portion extending above said side walls and having a lock tab receiving opening therein;

(e) bottom closure flaps foldably joined to lower edges of said side walls and secured to each other in overlapped relation to form an automatically erectable bottom wall;

(f) top closure panels having outboard edges foldably joined to upper edges of said side walls and having inboard edges;

(g) handle panels having lower edges foldably joined to adjacent inboard edges of respective top closure panels and having at opposed ends thereof laterally projecting lock tabs adapted to be received within related end wall openings;

(h) said end walls being arranged and disposed to bow outwardly from said side walls when said carton is erected, so that when said carton is filled and said top closure panels are lowered to closed position with said handle panels in face-to-face relation, said end walls will automatically move inwardly until said handle panel lock tabs are received and locked within said end wall openings.

5. A carton according to claim 4, wherein said handle panels have aligned finger receiving openings extending therethrough.

6. A carton according to claim 4, wherein said side walls each include three triangular panels that are foldably joined to each other and which are disposed to lie in separate planes.

7. A unitary blank of foldable sheet material, such as paperboard, for use in forming a collapsible, one-piece, bucket-type carton having an integral handle and having upper and lower ends that are closable by top and bottom self-locking closure arrangements, said blank being cut and scored to provide:

(a) a triangular first side wall center panel having a laterally extending upper edge and a pair of downwardly converging side edges;

(b) a pair of triangular first side wall side panels flanking said first side wall center panel, each having a laterally extending lower edge and a pair of upwardly converging inboard and outboard side edges, with its inboard side edge foldably joined to an adjacent side edge of said first side wall center panel;

(c) a pair of diamond shaped end wall panels flanking respective first side wall side panels, each having a pair of downwardly converging inboard and outboard side edges and a pair of upwardly converging upper edges, with their inboard side edges foldably joined to adjacent outboard side edges of respective first side wall side panels, and each having, extending upwardly beyond said first side wall center panel upper edge, an upper portion having a lock tab receiving opening therein;

(d) a pair of triangular second side wall side panels flanking respective end panels, each having a laterally extending lower edge and a pair of upwardly converging inboard and outboard side edges, with its inboard side edge foldably joined to an adjacent side edge of a related end wall panel;

(e) a pair of triangular second side wall center panel sections flanking respective second side wall side panels, each having a laterally extending upper edge and an upwardly and inboardly sloping side edge foldably joined to an adjacent outboard side edge of a related second side wall side panel;

(f) bottom closure flaps foldably joined to lower edges of said side wall side panels;

(g) top closure panels having lower edges foldably joined to upper edges of said side wall center panel and panel sections and having upper edges;

(h) handle panels having lower edges foldably joined to upper edges of respective top closure panels and having end edges from which extend lock tabs arranged and disposed to be received within said end wall openings when said blank is erected into a carton and closed.

8. A blank according to claim 7, wherein said handle panels have finger receiving openings extending therethrough.

9. A blank according to claim 7, wherein said end walls are diamond shaped and each includes a pair of triangular shaped panel sections foldably joined to each other.

10. A unitary blank of foldable sheet material, such as paperboard, for use in forming a collapsible, one-piece, bucket-type carton having an integral handle and having upper and lower ends that are closable by top and bottom self-locking closure arrangements, said blank being cut and scored to provide:

(a) a triangular first side wall center panel having a laterally extending upper edge and a pair of downwardly converging side edges;

(b) a pair of triangular first side wall side panels flanking said first side wall center panel, each having a laterally extending lower edge and a pair of upwardly converging inboard and outboard side edges, with its inboard side edge foldable joined to an adjacent side edge of said first side wall center panel;

(c) a pair of diamond shaped end wall panels flanking respective first side wall side panels, each having a pair of downwardly converging inboard and outboard side edges and a pair of upwardly converging upper edges, with their inboard side edges foldably joined to adjacent outboard side edges of respective first side wall side panels, and each having, extending upwardly beyond said first side wall center panel upper edge, and upper portion having a lock tab receiving opening therein;

(d) a pair of triangular second side wall side panels flanking respective end panels, each having a laterally extending lower edge and a pair of upwardly converging inboard and outboard side edges, with its inboard side edge foldably joined to an adjacent side edge of a related end wall panel;

(e) a triangular second side wall center panel flanking one of said second side wall side panels and having a laterally extending upper edge and an upwardly and inboardly sloping side edge foldably joined to an adjacent outboard side edge of said second side wall one side panel;

(f) a glue panel flanking the other of said second side wall side panels and having a side edge foldably joined to an adjacent outboard side edge of said second side wall other side panel;

(g) bottom closure flaps foldably joined to lower edges of said side wall side panels;

(h) top closure panels having lower edges foldably joined to upper edges of said side wall center panel and panel sections and having upper edges;

(i) handle panels having lower edges foldably joined to upper edges of respective top closure panels and having end edges from which extend lock tabs arranged and disposed to be received within said end wall openings when said blank is erected into a carton and closed.

11. A blank according to claim 10, wherein said handle panels have aligned finger receiving openings extending therethrough.

12. A blank according to claim 10, wherein said end walls are diamond shaped and each includes a pair of triangular shaped panel sections foldably joined to each other.

* * * * *